US006148999A

United States Patent [19]

Olson

[11] Patent Number: 6,148,999

[45] Date of Patent: Nov. 21, 2000

[54] PROTECTIVE HOOD FOR A GOLF BAG

[76] Inventor: David S. Olson, 2585 County Rd. 41, Omaha, Nebr. 68122

[21] Appl. No.: 09/277,033

[22] Filed: Mar. 25, 1999

[51] Int. Cl.[7] ..... A63B 55/00; A63B 57/00

[52] U.S. Cl. ..... 206/315.4; 150/159

[58] Field of Search ..... 206/315.4, 315.3; 150/159

[56] References Cited

U.S. PATENT DOCUMENTS

| | | | |
|---|---|---|---|
| 1,493,828 | 5/1924 | Stocks | 206/315.4 |
| 1,899,825 | 2/1933 | Reach | 206/315.4 |
| 3,985,171 | 10/1976 | Summers et al. | 206/315.4 |
| 4,249,586 | 2/1981 | Setani | 206/315.4 |
| 5,005,623 | 4/1991 | Webster, Jr. | 206/315.4 X |
| 5,407,723 | 4/1995 | Curtin | 150/159 X |
| 5,704,475 | 1/1998 | Jack | 206/315.4 |
| 5,810,064 | 9/1998 | Sanderson et al. | 206/315.4 X |
| 5,921,387 | 7/1999 | Arzoomanian et al. | 206/315.4 |
| 5,967,324 | 10/1999 | Izzo | 206/315.4 X |

FOREIGN PATENT DOCUMENTS

| | | | |
|---|---|---|---|
| 312232 | 3/1937 | Italy | 206/315.3 |

*Primary Examiner*—Sue A. Weaver
*Attorney, Agent, or Firm*—Zarley, McKee, Thomte, Voorhees & Sease; Dennis L. Thomte

[57] ABSTRACT

A protective hood for a golf bag wherein the hood comprises inner and outer members defining a compartment therebetween which is divided into an upper compartment and a lower compartment. The upper compartment in the hood is filled with a thick padding material while the lower compartment is filled with a layer of foam material. The hood is designed so that it may be used with golf bags having various diameters and carrying strap configurations.

12 Claims, 6 Drawing Sheets

PROTECTIVE HOOD FOR A GOLF BAG

BACKGROUND OF THE INVENTION

1. Field of the Invention

This invention relates to a protective hood for a golf bag and more particularly to a detachable protective hood for a golf bag which has thick padding associated therewith for protecting the upper ends of the golf clubs positioned in the golf bag.

2. Description of the Related Art

Many types of travel covers and hoods have been provided for golf bags. The conventional travel covers for golf bags are designed to enclose the entire golf bag as well as the heads of the golf clubs protruding from the upper end of the golf bag. While the conventional travel covers do afford some protection to the golf bag and the golf clubs therein, the travel covers ordinarily do not have sufficient padding associated therewith which surrounds the heads of the golf clubs, thereby creating the possibility that the clubs may be damaged if the bag is subjected to abuse during airport handling or while the golf bag is placed into an automobile trunk or removed therefrom. Further, the travel covers are normally removed from the golf bag during play or during temporary storage in an automobile trunk, thereby affording the clubs no protection during those periods of time.

Detachable hoods have been provided for golf bags, as previously described, but those hoods are normally for use as rain hoods and do not normally have any appreciable amount of padding associated therewith for protecting the heads of the golf clubs in the golf bag. A further problem existing in the construction of a hood for a golf bag is that the carrying strap for the golf bag may be either detachably connected to the upper rearward end of the bag by a D-ring and snap arrangement or may be semi-permanently or permanently attached to the bag. The design of a hood for a golf bag must therefore be directed to a particular type of bag which results in the necessity of several designs being necessary with attendant inventory problems.

SUMMARY OF THE INVENTION

A selectively removable and closeable hood is provided for a golf bag wherein the hood comprises a lower end which is somewhat padded and which is designed to embrace the upper end of the bag. The upper end of the hood is provided with a very thick layer of padding material which is positioned adjacent the heads of the golf clubs in the golf bag. The lower rearward end of the hood is designed so that the hood may be used with a golf bag wherein the carrying strap is connected to the golf bag by means of a D-ring and snap arrangement or a golf bag wherein the carrying strap is semi-permanently or permanently attached to the upper rearward end of the bag. An adjustable strap is also provided at the lower forward end of the hood for enabling the hood to be mounted on golf bags having various diameters.

The hood of this invention may be left on the golf bag during play to afford protection to the clubs and may be opened by means of a zipper to provide access to the clubs.

It is therefore a principal object of the invention to provide a protective hood for a golf bag.

Still another object of the invention is to provide a protective hood for a golf bag which may be secured to the golf bag regardless of the means of attaching the carrying strap to the golf bag.

Still another object of the invention is to provide a protective hood for a golf bag which has a very thick layer of padding material associated therewith which embraces the heads of the golf clubs in the golf bag.

Still another object of the invention is to provide a protective hood for a golf bag which may be adjusted to accommodate golf bags having various diameters.

Still another object of the invention is to provide a protective hood for a golf bag which is water impervious.

Still another object of the invention is to provide a protective hood for a golf bag which is easily secured to the golf bag and which is easily removed therefrom.

These and other objects of the invention will be apparent to those skilled in the art.

DESCRIPTION OF THE PREFERRED EMBODIMENT

Figure 1:
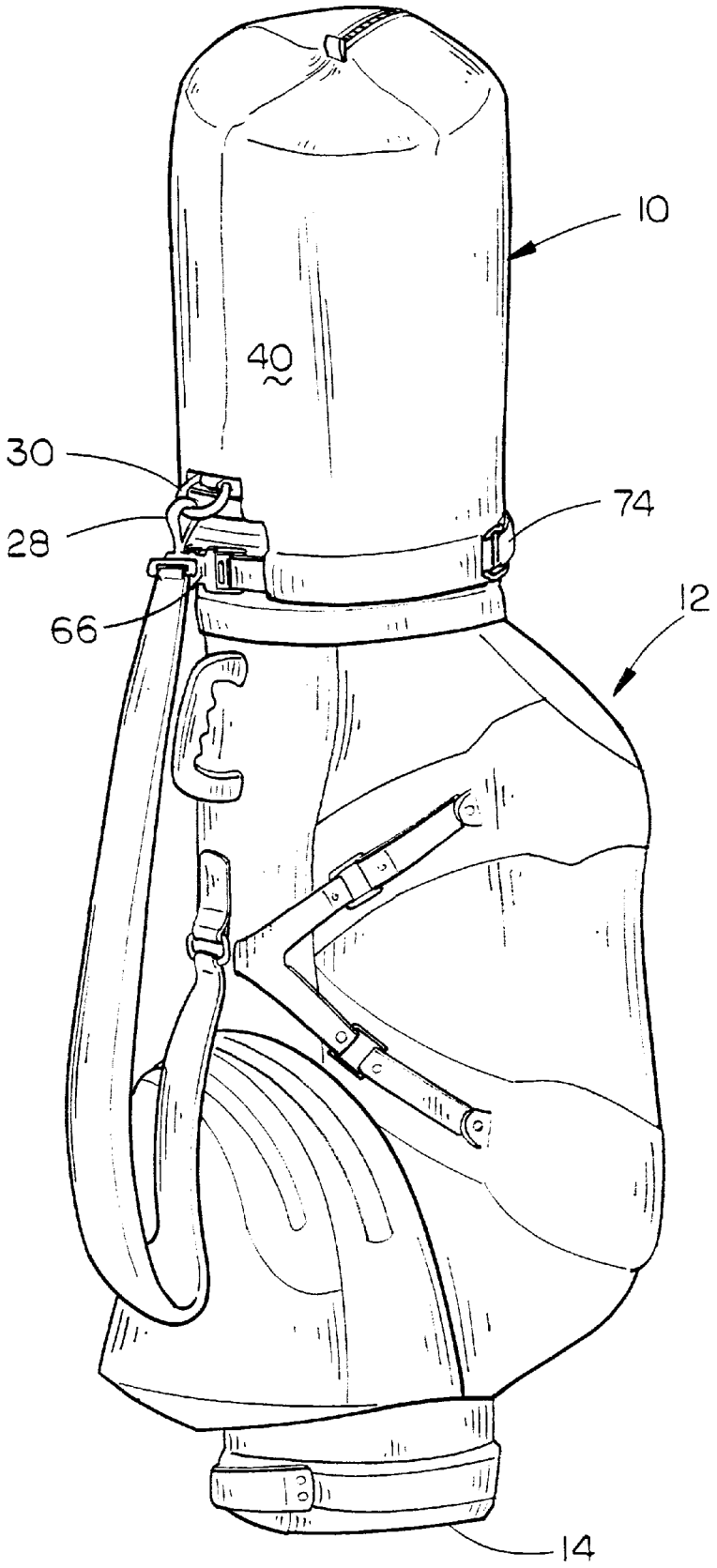
FIG. 1 is a rear perspective view of a golf bag having the protective hood of this invention mounted thereon.
Figure 2:
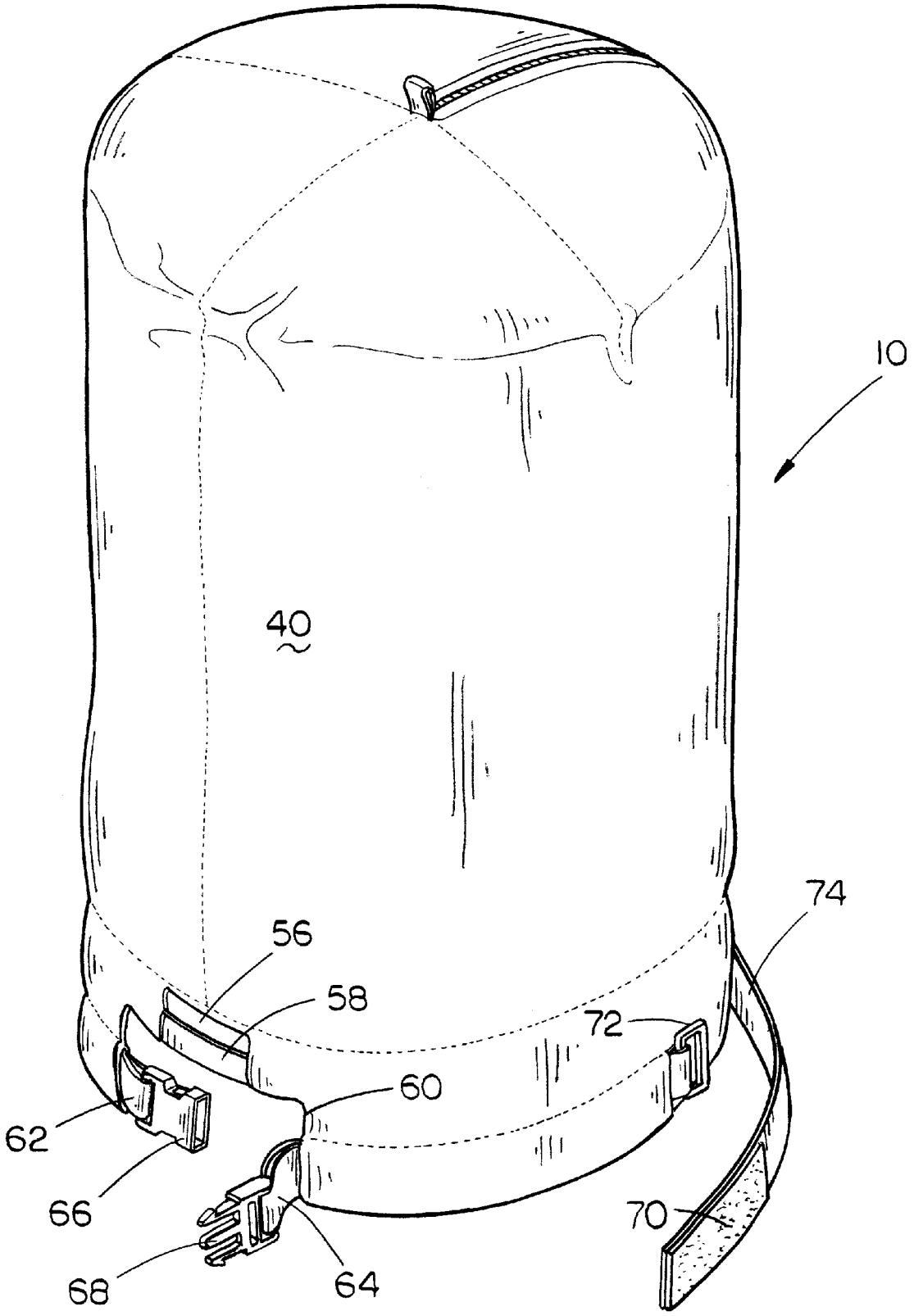
FIG. 2 is a rear perspective view of the hood of this invention.
Figure 4:
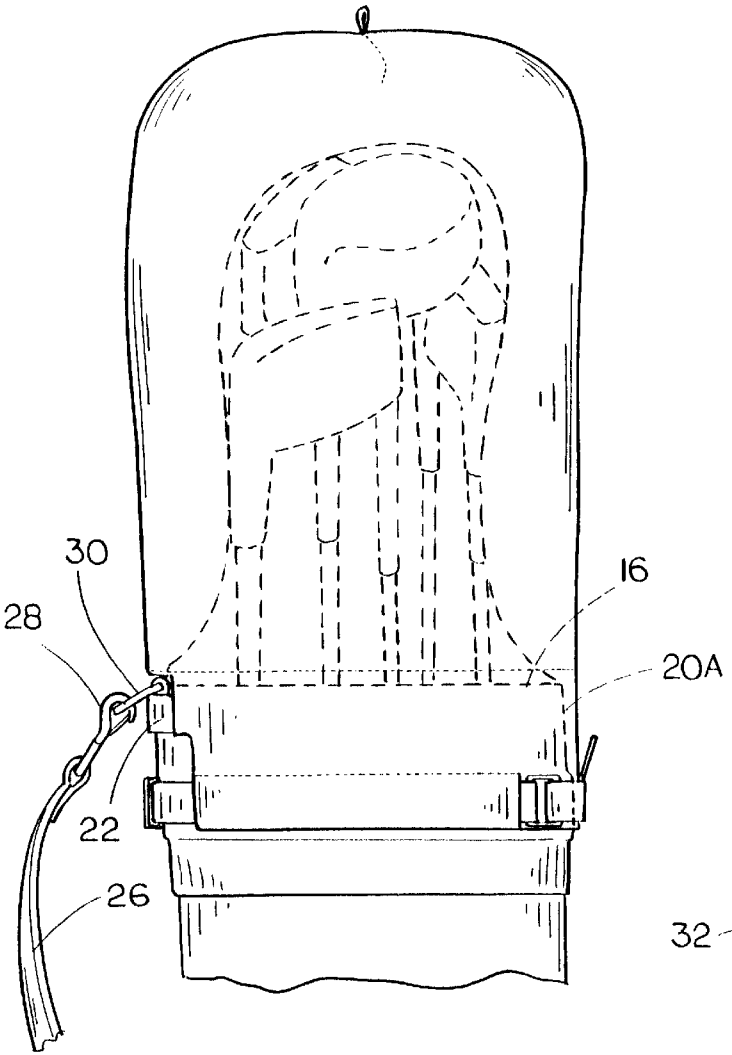
FIG. 4 is a side elevational view illustrating the hood of this invention being mounted on a golf bag wherein the carrying strap thereof is connected to the golf bag by means of a D-ring and snap attachment.

Referring now to the drawings, the numeral 10 refers generally to the protective hood of this invention which is designed to be secured to a golf bag 12. For purposes of description, bag 12 will be described as having a lower end 14 and an open upper end 16 which is designed to receive the golf clubs 18 therein. For purposes of description, opening 16 will be described as being defined by a bag rear wall portion 20, bag front wall portion 20A, and bag side wall portions 22 and 24. In the bag which is illustrated in FIGS. 1, 4 and 6, the carrying strap 26 is provided with a snap 28 at its upper end which is detachably connected to a D-ring 30 which is permanently affixed to the upper rearward end of the bag 12. In the bag illustrated in FIGS. 5 and 7, the carrying strap 32, which may be comprised of one or more straps, is either semi-permanently or permanently affixed to the upper rearward end of the bag 12. It is the different types of carrying strap configurations that make it difficult to design a hood for various types of golf bags, the solution of which is disclosed hereinafter.

For purposes of description, hood 10 will be described as having an open lower end 34, an upper end 36, rear end 38, and forward end 40. Hood 10 includes an outer member 42 which is preferably constructed of a polyester material having a urethane backing to waterproof the hood. Hood 10 also includes an inner member 44 which serves as a lining and which is preferably constructed of an oxford nylon material. Members 42 and 44 are split at their rearward ends and the hood is provided with a zipper 46 designed to close the hood or to open the same to gain access to the clubs. The zipper 46 also aids in positioning the hood on the golf bag, as will be described hereinafter.

The lower ends of members 42 and 44 are stitched together at 48 and are stitched together at 50. Stitching 50 creates an upper compartment or cavity 51 which is filled with a thick polyester material 52 such as POLY-FILL® which is a polyester fiber fill. Preferably, the padding 52 is approximately three inches thick. Stitching 48 and 50 creates a compartment 53 between the lower ends of the members 42 and 44 which is filled with polyurethane foam padding 54 having substantially less thickness than the padding 52.

The lower rearward end of hood 10 is provided with an opening 56 formed therein having an elastic strap 58 extending across the lower end thereof. The lower rearward end of hood 10 is also provided with an opening 60 formed therein having straps 62 and 64 extending across the lower end thereof and which may be connected together by means of the connectors 66 and 68.

Figure 3:
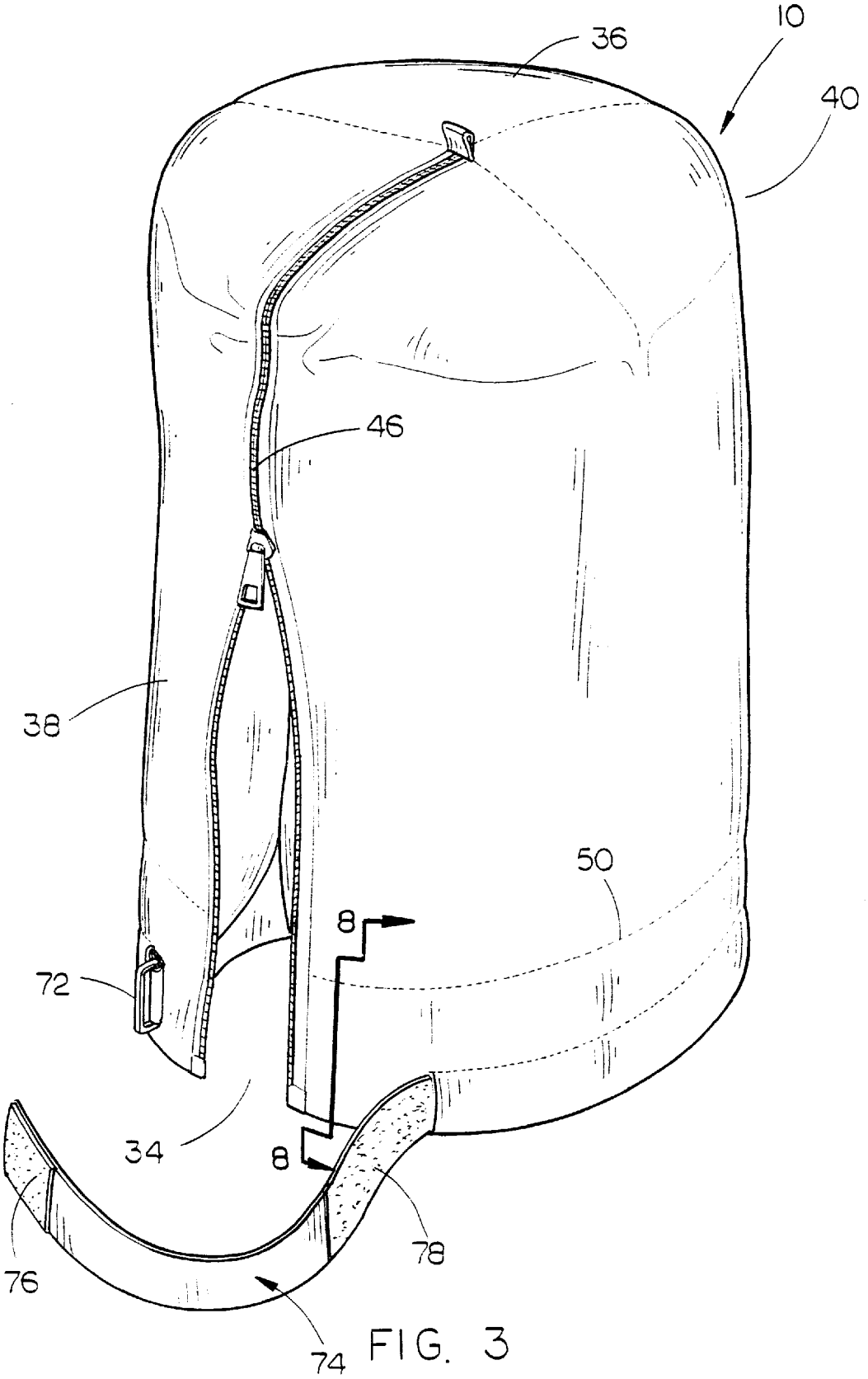
FIG. 3 is a front perspective view of the protective hood of this invention.

Strap member 70 is secured to hood 10 within one end of compartment 54 and has a ring 72 connected to the exposed outer end thereof. Strap 74 is secured to hood 10 and has one end thereof positioned within a portion of compartment 54. As seen in FIG. 3, the outer end of strap 74 is provided with a strip of Velcro hooks 76 provided on its outer surface thereof adjacent the outer end thereof. Strap 74 is also provided with a strip of Velcro loops 78 for a purpose to be described hereinafter.

Assuming that the hood 10 is to be used with the type of bag illustrated in FIGS. 1, 4 and 6, the hood 10 is installed on the golf bag as follows. Zipper 46 is opened and the strap 74 is disconnected from the ring 72. The snap 28 is disconnected from the D-ring 30 with the hood 10 then being positioned relative to the bag 12 so that the D-ring 30 protrudes outwardly through the opening 56 above strap 58. Although strap 58 is described as being continuous, it could be constructed of two strap members with connectors thereon similar to the straps 62 and 64 which have the connectors 66 and 68 thereon. Once the D-ring 30 has been extended through the opening 56, snap 28 is reattached to D-ring 30. Connectors 66 and 68 are then secured together, as illustrated in FIG. 6. When the hood 10 is positioned as illustrated in FIG. 6, the layer of padding material 54 will be positioned at the exterior of the upper end of the bag 10 with the layer of padding material 52 being positioned above the upper end of the golf bag so as to be able to enclose and embrace the golf clubs. Zipper 46 is then closed and the free end of the strap 74 is inserted through the ring 72 with the strap 74 being folded upon itself so that the hook 76 may engage the to loops 74. The strap 74 enables the lower end of the hood 10 to be securely tightened around the upper end of the bag regardless of the outer diameter of the bag. The strap 74 enables the hood 10 to be secured to bags having parameters of seven and a half to ten inches.

When the hood 10 is installed on the bag, the padding material 52 is compressed around the upper ends of the clubs and affords great protection to the clubs. The hood 10 may be left on the bag during travel and may be left on the bag during play, if so desired.

Figure 5:
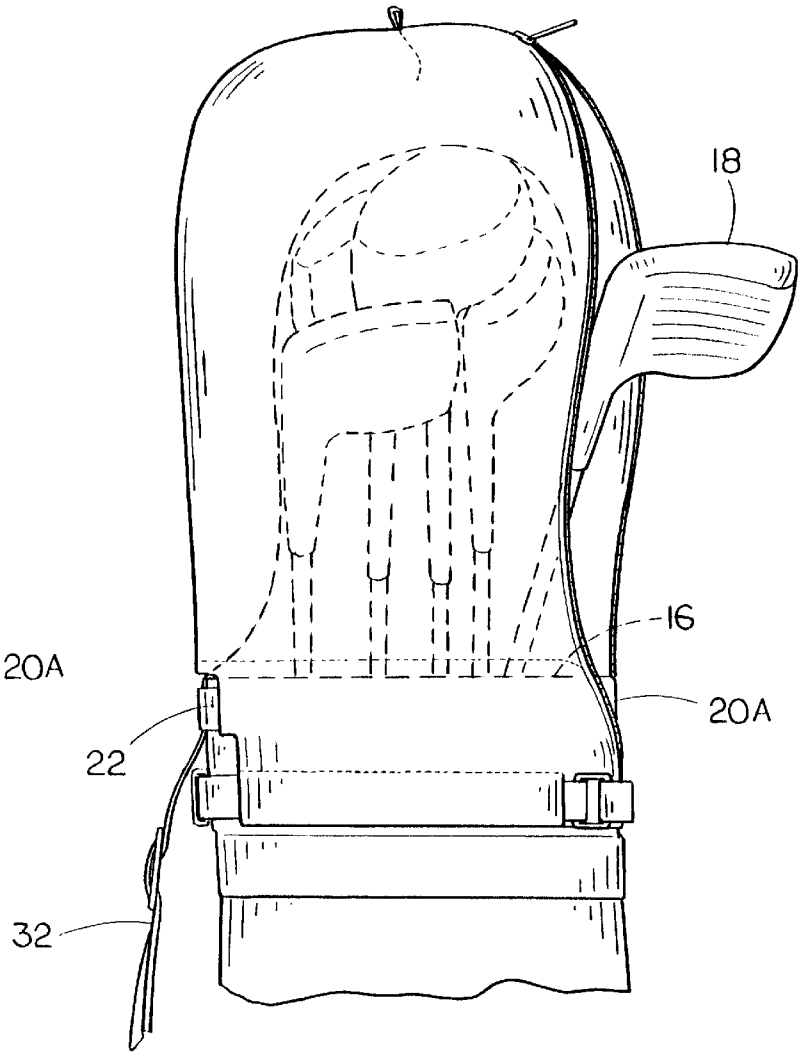
FIG. 5 is a view similar to FIG. 4 except that the protective hood is illustrated on a golf bag wherein the carrying strap is semi-permanently or permanently attached to the upper rearward end of the golf bag.
Figure 7:
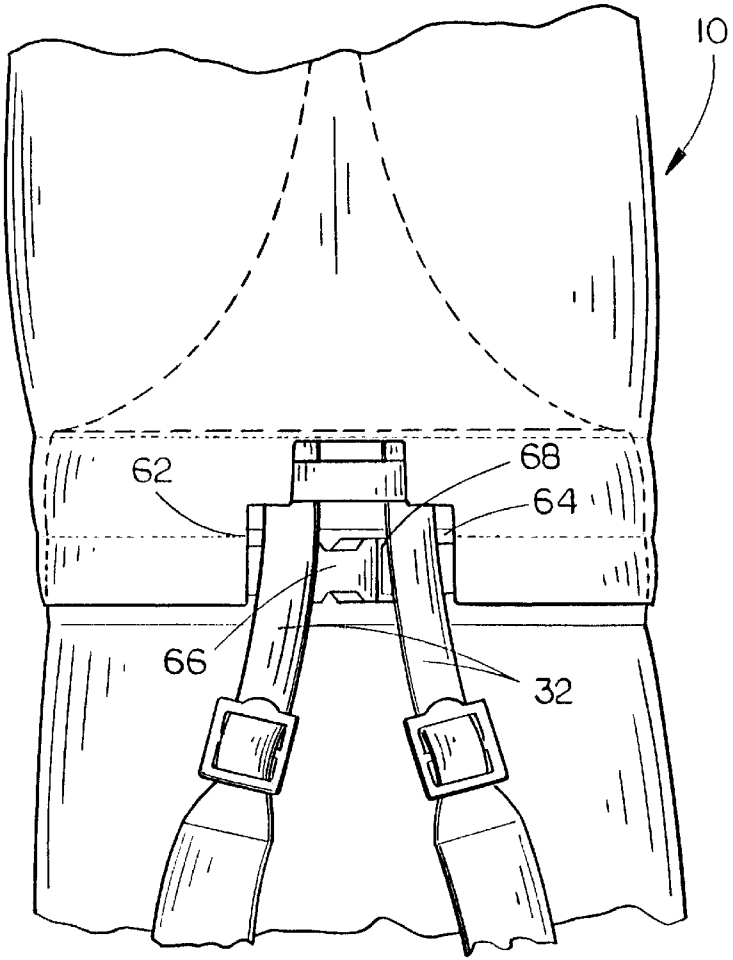
FIG. 7 is a rear view of the bag and hood of FIG. 5.
Figure 6:
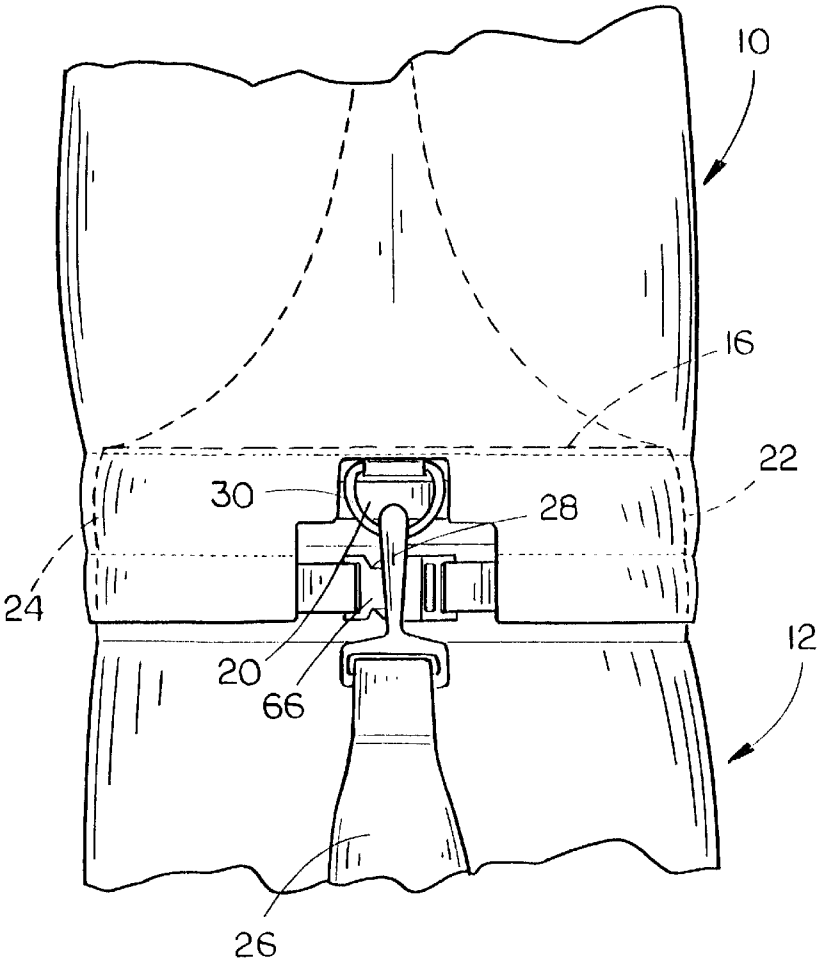
FIG. 6 is a rear view of the bag and hood of FIG. 4.
Figure 8:
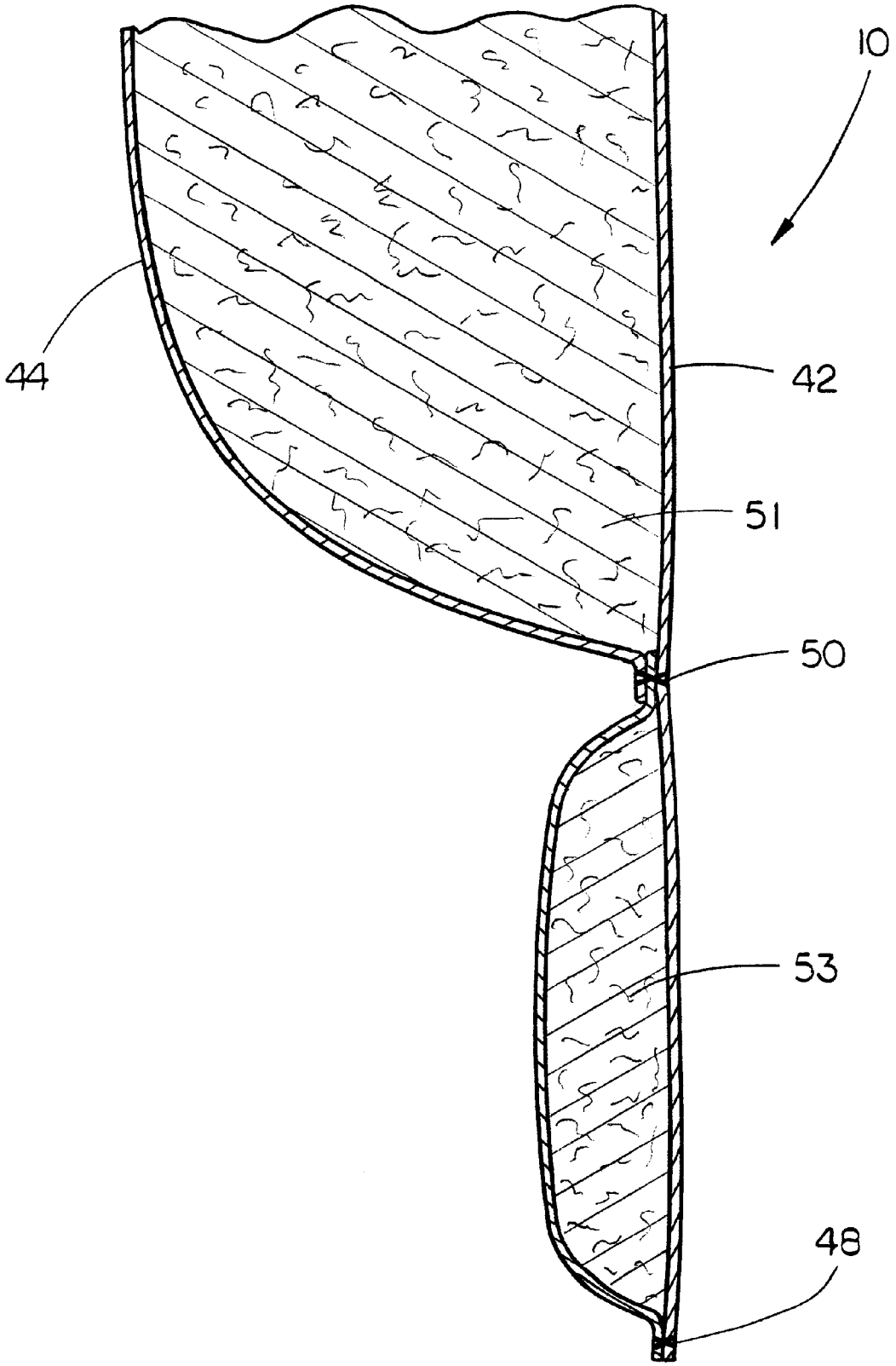
FIG. 8 is an enlarged sectional view as seen on lines 8—8 of FIG. 3.

When the hood 10 is to be used with the types of golf bags which do not utilize D-rings, but is to be used with the type of golf bag such as illustrated in FIGS. 5 and 7, the hood 10 is installed on the bag 12 as follows. Zipper 46 is initially opened and the strap 74 is initially disconnected. Connectors 66 and 68 are disconnected at this time. Hood 10 is then positioned on the bag 12 so that the straps 32 protrude outwardly through the opening 60, as seen in FIG. 7. The connectors 66 and 68 are then connected together between the straps 32 and the exterior of the bag 12, as seen in FIG. 7, so that the straps 32 protrude outwardly through the opening 60 above the straps 62 and 64. The zipper 46 is closed and the strap 74 is then extended through the ring 72 and folded upon itself to enable the hook 76 to engage the loop 78.

Thus it can be seen that a novel protective hood has been provided for a golf bag which not only affords great protection to the clubs in the golf bag, but which also enables the hood to be installed on golf bags having various diameters. Further, it can be seen that the protective hood of this invention can also be mounted on golf bags regardless of the manner in which the carrying strap thereof is secured to the bag. It can also be seen that the protective hood of this invention not only protects the golf clubs during travel, but also protects the clubs during use.

Thus it can be seen that the invention accomplishes at least all of its stated objectives.

I claim:

1. A detachable protective hood for use on a golf bag wherein the shoulder strap thereof is either connected to the upper end of the golf bag by means of a ring affixed to the golf bag or by means of one or more shoulder strap members affixed to the golf bag, comprising:

first and second hood side wall portions having an upper end, a lower end, a forward end, and a rearward end;

a hood rear wall portion extending between said first and second hood side wall portions having upper and lower ends;

and a hood top wall portion extending between the upper ends of said first and second hood side wall portions and rear wall portion;

a zipper means at the forward ends of said hood side wall portions extending into said hood top wall portion;

a protective layer of padding material associated with said hood wall portions to protect the upper ends of golf clubs in the golf bag;

said lower end of said hood rear wall portion having a substantially inverted U-shaped opening formed therein and wherein a first strap means extends across said inverted U-shaped opening to define a first opening thereabove for receiving the shoulder strap extending therethrough;

and a second strap means extending across said inverted U-shaped opening to define a second opening thereabove for receiving the ring therein.

2. The detachable protective hood of claim 1 wherein said first strap means is comprised of first and second strap members which may be detachably secured together.

3. The detachable protective hood of claim 2 wherein an adjustable strap is provided at the lower forward ends of said hood side wall portions for securing the hood to the upper end of the golf bag.

4. A detachable protective hood for use on a golf bag wherein the shoulder strap thereof is either connected to the upper end of the golf bag by means of a ring affixed to the golf bag or by means of one or more shoulder strap members affixed to the golf bag, comprising:

first and second hood side wall portions having an upper end, a lower end, a forward end, and a rearward end;

a hood rear wall portion extending between said first and second hood side wall portions having upper and lower ends;

and a hood top wall portion extending between the upper ends of said first and second hood side wall portions and rear wall portion;

a zipper means at the forward ends of said hood side wall portions extending into said hood top wall portion;

and a protective layer of padding material associated with said hood wall portions to protect the upper ends of golf clubs in the golf bag;

said protective layer of padding material comprising a fiber material;

said protective layer of padding material having a thickness of approximately three inches.

5. A detachable protective hood for use on a golf bag wherein the shoulder strap thereof is either connected to the upper end of the golf bag by means of a ring affixed to the golf bag or by means of one or more shoulder strap members affixed to the golf bag, comprising:

first and second hood side wall portions having an upper end, a lower end, a forward end, and a rearward end;

a hood rear wall portion extending between said first and second hood side wall portions having upper and lower ends;

and a hood top wall portion extending between the upper ends of said first and second hood side wall portions and rear wall portion;

a zipper means at the forward ends of said hood side wall portions extending into said hood top wall portion;

and a protective layer of padding material associated with said hood wall portions to protect the upper ends of golf clubs in the golf bag;

said protective layer of padding material comprising a compressible material.

6. The detachable protective hood of claim 5 wherein said protective layer of padding material has a thickness of approximately three inches.

7. In combination with a golf bag having a lower end and an upper end; said upper end of the golf bag having an opening formed therein for receiving golf clubs therein; said opening in said upper end of said golf bag being defined by a bag rear wall portion, first and second bag side wall portions, and a bag front wall portion; said golf bag including a carrying strap means having upper and lower ends; said upper end of said carrying strap means being secured to said bag rear wall portion adjacent said opening in said upper end of said golf bag;

a selectively closeable hood selectively detachably mounted on said upper end of said golf bag for embracing the upper ends of the golf clubs in said golf bag;

said hood having a protective layer of padding material associated therewith to protect the upper ends of the golf clubs in said golf bag;

said hood having upper and lower ends and including a hood rear wall portion and first and second hood wall portions selectively joined together by a zipper means;

said lower end of said hood rear wall portion having an opening formed therein;

said bag including a ring means secured to said bag rear wall portion adapted to have the said upper end of said carrying strap means secured thereto;

and a first strap means extending across the upper end of said opening of said hood rear wall to define an opening thereabove to permit said ring means to extend outwardly therethrough.

8. The combination of claim 7 wherein said first strap means is comprised of an elastic material.

9. In combination with a golf bag having a lower end and an upper end; said upper end of the golf bag having an opening formed therein for receiving golf clubs therein; said opening in said upper end of said golf bag being defined by a bag rear wall portion, first and second bag side wall portions, and a bag front wall portion; said golf bag including a carrying strap means having upper and lower ends; said upper end of said carrying strap means being secured to said bag rear wall portion adjacent said opening in said upper end of said golf bag;

a selectively closeable hood selectively detachably mounted on said upper end of said golf bag for embracing the upper ends of the golf clubs in said golf bag;

said hood having a protective layer of padding material associated therewith to protect the upper ends of the golf clubs in said golf bag;

said hood having upper and lower ends and including a hood rear wall portion and first and second hood wall portions selectively joined together by a zipper means;

said lower end of said hood rear wall portion having an opening formed therein;

a first strap means extending between said first and second hood side wall portions across the lower end of said opening of said hood rear wall;

and a second strap means extending across the lower end of said opening in said hood rear wall below said first strap means to define an opening between said first and second strap means to permit said carrying strap means to extend therethrough.

10. In combination with a golf bag having a lower end and an upper end; said upper end of the golf bag having an opening formed therein for receiving golf clubs therein; said opening in said upper end of said golf bag being defined by a bag rear wall portion, first and second bag side wall portions, and a bag front wall portion; said golf bag including a carrying strap means having upper and lower ends; said upper end of said carrying strap means being secured to said bag rear wall portion adjacent said opening in said upper end of said golf bag;

a selectively closeable hood selectively detachably mounted on said upper end of said golf bag for embracing the upper ends of the golf clubs in said golf bag;

said hood having a protective layer of padding material associated therewith to protect the upper ends of the golf clubs in said golf bag;

said protective layer of padding material terminating above lower ends of first and second hood side wall portions and hood rear wall portion;

said hood having a second layer of padding material provided therein below said protective layer of padding material;

said second layer of padding material having a thickness less than said protective layer of padding material.

11. The combination of claim 10 wherein said second layer of padding material is comprised of a foam material.

12. The combination of claim 11 wherein said protective layer of padding material is comprised of a fiber material.

* * * * *